United States Patent [19]

Engelen

[11] 4,234,818

[45] Nov. 18, 1980

[54] ELECTRIC MIXED LIGHT LAMP

[75] Inventor: Willy L. J. Engelen, Eindhoven, Netherlands

[73] Assignee: U.S. Philips Corporation, New York, N.Y.

[21] Appl. No.: 22,746

[22] Filed: Mar. 22, 1979

[30] Foreign Application Priority Data

Apr. 17, 1978 [NL] Netherlands ..... 7804040

[51] Int. Cl.[3] ..... H01J 7/44

[52] U.S. Cl. ..... 315/49; 315/52

[58] Field of Search ..... 315/49, 52

[56] References Cited

U.S. PATENT DOCUMENTS

| | | | |
|---|---|---|---|
| 2,517,126 | 8/1950 | Macksoud | 315/49 |
| 3,048,741 | 8/1962 | Thouret | 315/49 |
| 3,445,719 | 5/1969 | Thouret et al. | 315/49 |

*Primary Examiner*—Eli Lieberman
*Assistant Examiner*—Charles F. Roberts
*Attorney, Agent, or Firm*—Robert S. Smith

[57] ABSTRACT

Mixed light lamps require a complicated construction so as to be able to suspend the filament and the discharge lamp. In a mixed light lamp according to the invention a bipartite filament of coiled-coil wire is used, the parts of which are each stretched between one pole wire and a current supply conductor of the discharge lamp.

1 Claim, 1 Drawing Figure

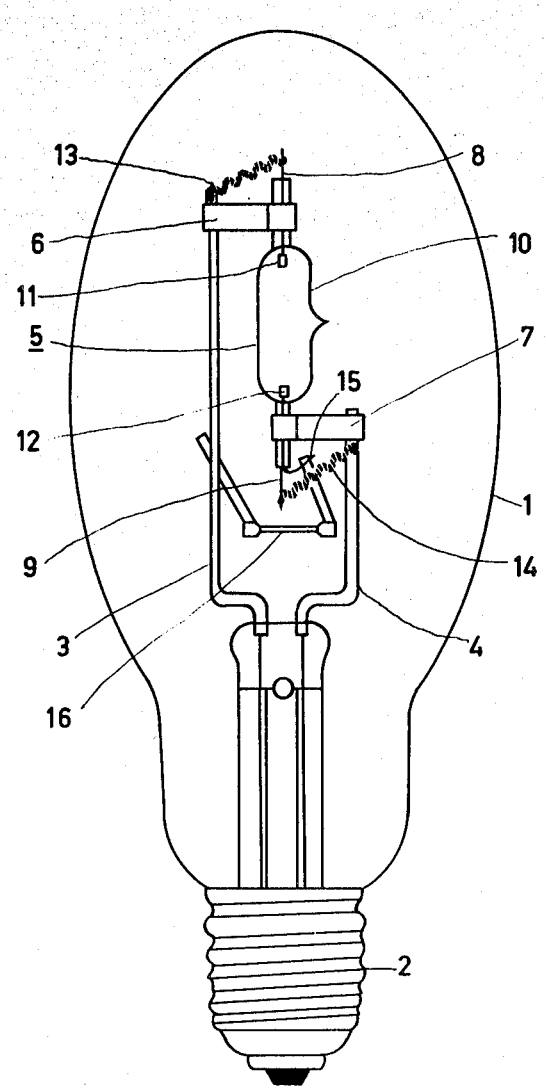
13
8
6
10
11
5
7
15
12
1
9
14
3
4
16
2

ELECTRIC MIXED LIGHT LAMP

The invention relates to an electric mixed light lamp of the type having a vacuum-tight sealed lamp envelope in which pole wires are passed through the wall of the lamp envelope. Also in the lamp envelope a high pressure discharge tube is accommodated having current supply wires which extend in a vacuum-tight manner through the wall of the discharge vessel to the electrodes, and in which lamp envelope a bipartite incandescent filament is present the parts of which are connected electrically in series mutually and with the discharge lamp. Such a lamp is disclosed, for example, in U.S. Pat. No. 2,517,126.

In the known lamp the two parts of the filament extend along opposite sides of the discharge tube and parallel thereto. For that purpose, a frame of which the pole wires form a part is present in the lamp envelope. In order to prevent a shortcircuit between the pole wires, insulating members have been used in the construction of the frame, with the result that the lamp is very complicated and its manufacture is difficult to mechanize.

The filament of the known lamp is a conventional single coiled filament and this means that it has to be supported in a number of places intermediate its ends by mutually-insulated supporting members (also see, for example, British Patent Specification No. 484,328 and U.S. Pat. No. 3,445,719). This results in a further complication of the construction.

It is the object of the invention to provide a mixed light lamp having a very simple set construction, the manufacture of which can easily be mechanised.

According to the invention, this object is achieved in an electric mixed light lamp of the type described in the preamble in that the filament is a coiled-coil filament and each of the parts of the filament is stretched between a respective pole wire and a respective current supply conductor.

The advantage of the lamp according to the invention is that the construction hardly differs from that of high-pressure discharge lamps which are operated with a ballast accommodated outside the lamp. Moreover the two parts of the filament are so compact that they need not be supported intermediate their ends.

Other advantages of the lamp according to the invention are, that

- the use of a coiled-coil filament gives a higher luminous efficiency;
- the lamp reaches the operating temperature more rapidly after switching on, as a result of which a higher load of the filament is possible;
- the variation in lamp life is smaller as a result of the absence of intermediate supports;
- the lamp is less sensitive to variations in the operating position.

In a conventional mixed light lamp, as described, for example, in the above-mentioned British Patent Specification, the single-coiled filament cannot be replaced by a coiled-coil filament without disturbing the thermal balance of the lamp. The much shorter coiled-coil filament would have to be assembled around the discharge lamp, also by means of a number of intermediate supporting members, but a fair chance of flash-over would occur between the ends of the filament which would be done together.

In the lamp according to the invention there is no likelihood of flash-over. The parts of the filament are situated at a distance from each other whereas, contrary to that of the U.S. Pat. No. 2,517,126, the discharge lamp is connected electrically between the two filament parts.

From the point of view of manufacture and design it is convenient to give the two filament parts the same resistance value, although this is not necessary for any technical reason.

An embodiment of a lamp according to the invention will now be described in detail with reference to the drawing and the example, the sole FIGURE of the drawing showing an elevation of an electric mixed light lamp.

In a glass lamp envelope 1 has disposed therein a lamp cap 2, and pole wires 3 and 4 which extend through the wall of the lamp envelope in a vacuum-tight manner. The pole wires 3 and 4 are connected to the lamp cap 2. A high-pressure mercury vapour discharge lamp 5 is present in the lamp envelope and is suspended from the pole wires 3 and 4 by metal strips 6 and 7. Current supply conductors 8 and 9 extend in a vacuum-tight manner through the wall of the discharge vessel 10 to respective electrodes 11 and 12 accommodated therein. A first coiled-coil filament part 13 is stretched between pole wire 3 and current supply conductor 8 and a second coiled-coil filament part 14 is stretched between pole wire 4 and current supply conductor 9. The current supply conductor 15 to an ignition electrode (not visible in the drawing) is connected to the pole wire 3 via a resistive element 16.

EXAMPLE

In a practical case a high-pressure mercury vapor discharge lamp was mounted in a lamp envelope filled with $Ar/N_2$(85% by volume Ar; 15% by volume $N_2$) to a pressure of 0.6 bar. Two identical filament parts of 11 mm length of coiled-coil tungsten wire of 64.8 $\mu$m thickness were each stretched symmetrically in the lamp envelope between a respective pole wire and a respective current supply wire.

During operation the lamp consumed a power of 160 W at 220–230 V of which 50 W were dissipated by the discharge lamp.

What is claimed is:

1. An electric mixed light lamp which comprises:
   - a single vacuum-tight sealed lamp envelope,
   - at least first and second pole wires extending through the wall of said lamp envelope,
   - a high pressure discharge tube having first and second electrodes disposed in said lamp envelope,
   - first and second current supply wires which extend respectively in a vacuum-tight manner through the wall of said discharge tube to said first and second electrodes, and
   - first and second incandescent filaments disposed in said envelope which are each connected electrically in series mutually and with said discharge lamp, each of said filaments being a coiled-coil filament, said first filament being stretched between said first pole wire and said first current supply conductor, said second filament being stretched between and fixed to said second pole wire and said second current supply conductor.

* * * * *